US005864903A

United States Patent [19]

Newman

[11] Patent Number: 5,864,903

[45] Date of Patent: Feb. 2, 1999

[54] PILLOW WITH STORAGE POCKET CONTAINING A CONDOM

[76] Inventor: Hope Newman, 435 E. 12th St., Apt. 13, New York, N.Y. 10009

[21] Appl. No.: 13,575

[22] Filed: Jan. 27, 1998

Related U.S. Application Data

[60] Provisional application No. 60/042,612 Apr. 4, 1997.

[51] Int. Cl.[6] ..... A47G 9/00

[52] U.S. Cl. ..... 5/639; 5/636; 5/640; 128/844; 128/918

[58] Field of Search ..... 5/639, 636, 640, 5/645, 485; 128/844, 918; D6/601

[56] References Cited

U.S. PATENT DOCUMENTS

| | | | |
|---|---|---|---|
| Re. 17,057 | 7/1928 | Volt . | |
| D. 338,362 | 8/1993 | Schlosser | D6/601 |
| D. 353,073 | 12/1994 | Birk | D6/601 |
| 1,382,831 | 6/1921 | Hilker . | |
| 1,515,467 | 11/1924 | Draving . | |
| 2,962,731 | 12/1960 | Bounds | 5/639 |
| 3,863,283 | 2/1975 | Mohr . | |
| 4,688,286 | 8/1987 | Miker, Jr. | 5/490 |
| 4,768,245 | 9/1988 | Dutton . | |
| 5,138,728 | 8/1992 | Aston | 5/645 |
| 5,172,430 | 12/1992 | Lerma-Solis | 2/400 |
| 5,460,188 | 10/1995 | Barrett, Sr. | 128/842 |
| 5,475,886 | 12/1995 | Mintz | 5/639 |

FOREIGN PATENT DOCUMENTS

| | | | |
|---|---|---|---|
| 1023202 | 1/1958 | Germany | 5/485 |

*Primary Examiner*—Alex Grosz
*Attorney, Agent, or Firm*—Gottlieb, Rackman & Reisman, P.C.

[57] ABSTRACT

A pillow having a storage pocket sized for retaining a packaged condom is provided. The storage pocket is located in the center of one side of the pillow, and is integrally formed with a seam running across the pillow face so that the pocket is substantially hidden from view. The pocket is sized such that a stored condom can be easily retrieved, yet small enough so that the packaged condom will not fall out, even when the pillow is shaken.

19 Claims, 2 Drawing Sheets

PILLOW WITH STORAGE POCKET CONTAINING A CONDOM

This application is a Provisional of Ser. No. 60/042,612 filed Apr. 4, 1997.

This invention relates to a combination pillow and storage pocket, and more particularly, to a pillow having a pocket formed therein that is especially suitable for receiving and retaining a packaged condom.

Sexually transmitted diseases such as AIDS and venereal diseases are a tremendous problem in society. To combat the spread of these diseases, sexual educators advocate the use of condoms during sexual activity as a substantial measure for preventing transmission of the disease.

Unfortunately, participants in sexual activities are frequently unprepared, or find it inconvenient, and therefore, do not use condoms on a regular basis.

Accordingly, Applicant has come up with the instant invention in order to increase the likelihood that sexual participants will not have unprotected sex.

SUMMARY OF THE INVENTION

Generally speaking, in accordance with the invention, a pillow having a storage pocket sized for retaining a packaged condom is provided. The storage pocket is located in the center of one side of the pillow, and is integrally formed with a seam running across the pillow face so that the pocket is substantially hidden from view. The pocket is sized such that a stored condom can be easily retrieved, yet small enough so that the packaged condom will not fall out, even when the pillow is shaken.

Significantly, the pillow material which defines the outside of the pocket contains a filler material such as "batting" so that the stored packaged condom is not easily felt.

In addition, since the pocket entrance is placed across the middle of the pillow face, it will remain securely closed and effectively pinned down by the seam running on either side thereof.

Accordingly, it is an object of the invention to provide an improved pillow design.

Still another object of the invention is to provide a pillow design having a pocket on one face thereof sized for receiving a packaged condom.

Yet a further object of the invention is to provide a pillow design having a pocket substantially hidden from view in which a packaged condom may be stored.

Still other objects and advantages of the invention will in part be obvious and will in part be apparent.

The invention accordingly comprises the features or construction as described in the following description, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figure 1:
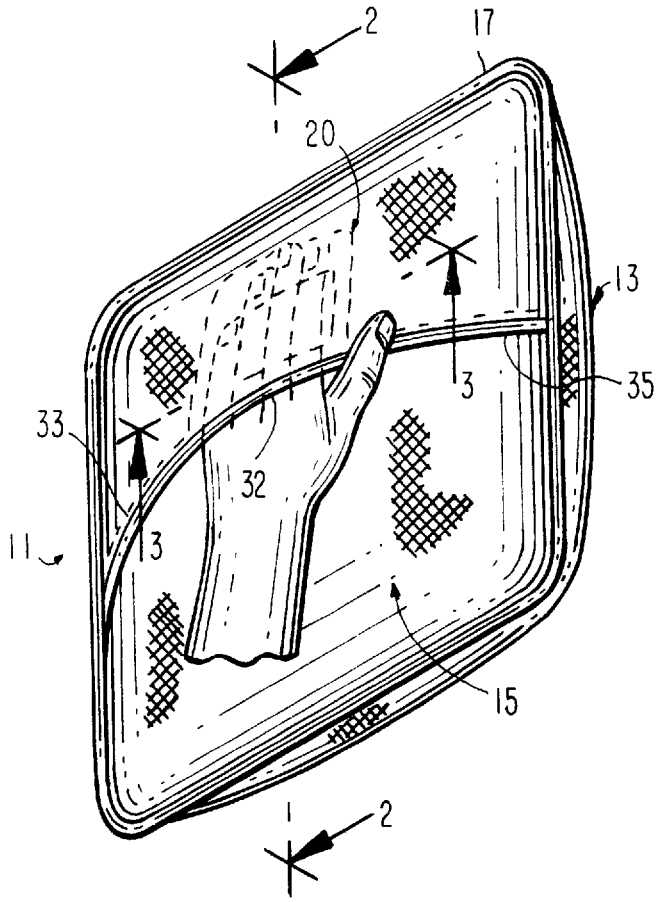
FIG. 1 is a perspective view of the pillow of the invention in which a user's hand is shown reaching into a pocket formed along one face thereof.

Referring to FIG. 1, a pillow 11, made in accordance with the invention, is now described. Pillow 11 has a substantially square-shaped configuration and includes a front face 13 separated from a back face 15 by a running trim 17 located along the edges of pillow 11 which effectively hides the pillow seam running therealong. Front face 13 is defined by a front fabric panel 21, while back face 15 is defined by a back fabric panel 25 and a somewhat overlying flap fabric panel 29 (see FIG. 2).

Fabric panels 21, 25 and 29 may be imprinted with a common fabric design that is visually appealing. As can be appreciated, the lower edge of back fabric panel 25 is sewn to the lower edge of front fabric panel 21 along seam 19, while the upper edge of flap fabric panel 29 is sewn to the upper edge of front fabric panel 21 along seam 18. Seams 18 and 19 are hidden from view by trim 17, as shown in FIG. 1. Fabric panels 21, 25 and 25 together define an inside filled with foam 23 or other suitable pillow stuffing material, as is well known in the art.

Referring to all of the figures, back face 15 of pillow 11 is formed with a centrally disposed pocket, generally indicated at 20, sized for receiving a packaged condom 39 in receptacle 31. Pocket 20 is defined by a folded over pocket fabric panel 27 having one edge sewn to the middle portion of the lower edge of flap fabric panel 29 along a seam 33 and the opposite edge sewn to the upper edge of back fabric panel 25 along a seam 37 (see FIG. 2).

Significantly, seam 33 runs completely across back face 15 of pillow 11, as shown in FIG. 1. Accordingly, on either side of pocket 20, seam 33 defines where the lower edge of flap fabric panel 29 is further sewn to the upper edge of back fabric panel 25. In order to make pillow 11 more aesthetically pleasing, seam 33 is hidden from view by a trim material 35 which preferably matches trim 17 running along the outside edge of pillow 11.

Figure 2:
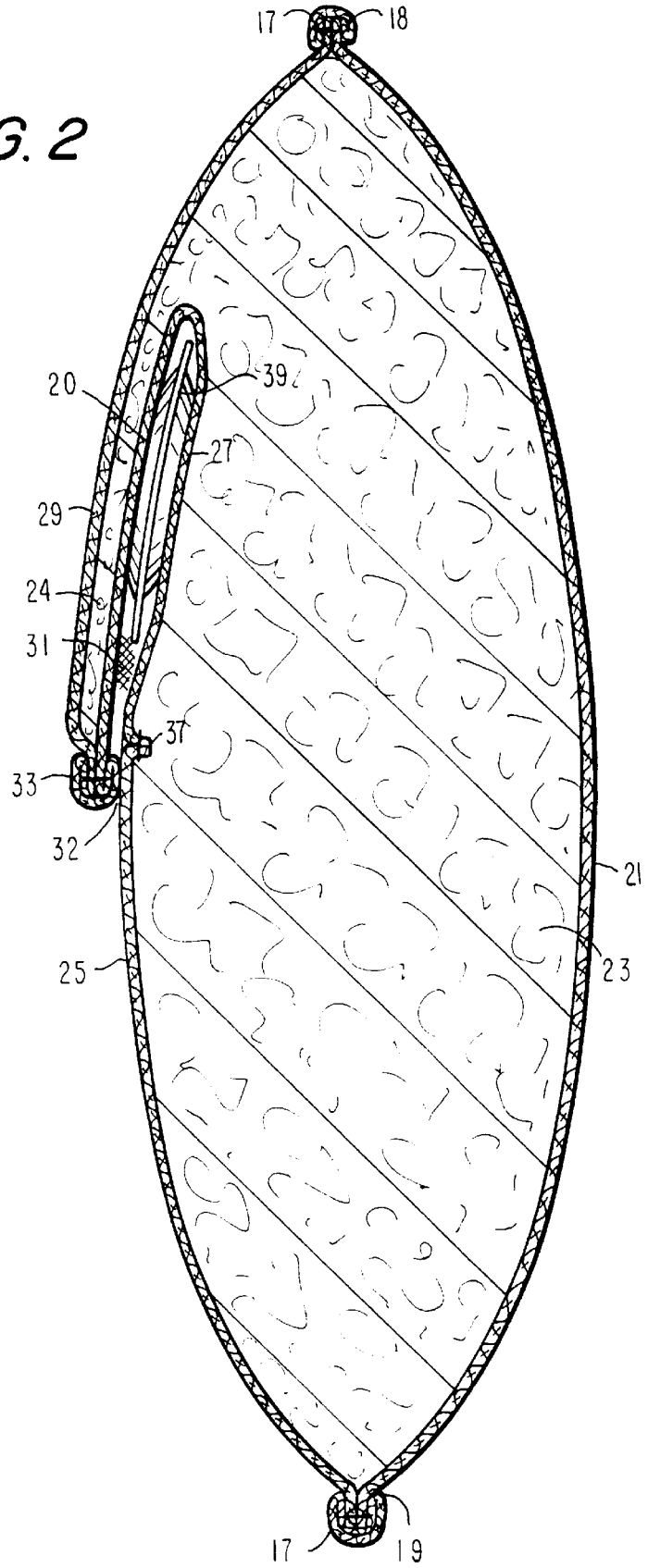
FIG. 2 is a cross-sectional view taken along line 2—2 of FIG. 1.

Referring to FIG. 2, and specifically to pocket 20, where flap fabric panel 29 overlies pocket fabric panel 27, there is provided therebetween batting 24 or some other stuffing material so that pocket 20, with a packaged condom 39 retained therein, is not easily felt. In addition, if an individual sits against back face 15 of pillow 11 for an extended period of time and then gets up, batting 24 will prevent the retained packaged condom from leaving any type of imprint due to pressure.

Figure 3:
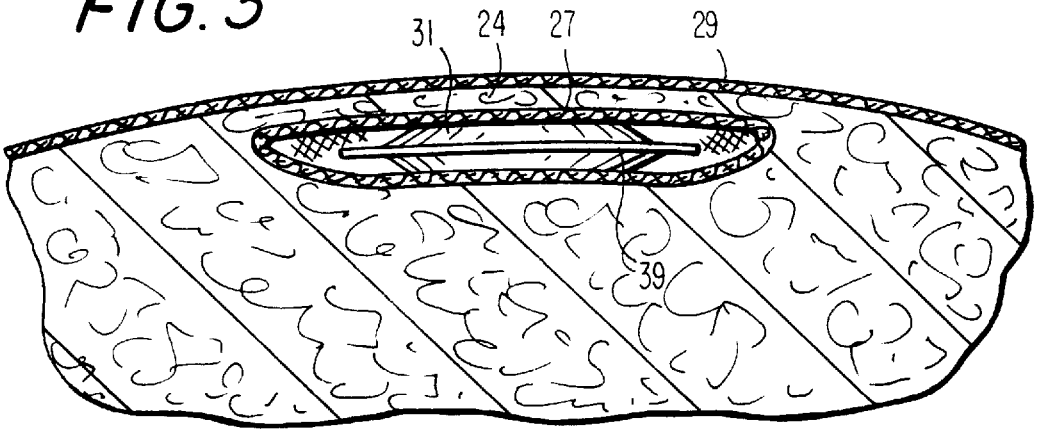
FIG. 3 is a cross-sectional view taken along line 3—3 of FIG. 1.

As shown in FIGS. 2 and 3, pocket 20 defines an interior compartment 31, which is accessed through an entrance 32 (FIG. 1). Compartment 31 is sized slightly larger in both length and width to that of a conventionally sized packaged condom 39 (typically, a condom package is 2½×2½ inches). Specifically, compartment 31 will have both a length and a width in the range of 4.5–6.0 inches, with 5 inches square being preferred. This sizing enables the condom to be easily placed within and retrieved from compartment 31 of pocket 20 by reaching one's hand through entrance 32 (see FIG. 1). As described below, running seam 33 in combination with the sizing of compartment 31 prevents the packaged condom from falling out from pocket 20, even if pillow 11 is thrown, shaken or severely jarred.

Importantly, pocket 20 is not formed with any type of closure such as a zipper or button. This design enable the packaged condom to be easily removed through entrance 32 without one having to play with some type of closure mechanism. Nonetheless, because entrance 32 to compartment 31 of pocket 20 is placed substantially across seam 33 running along the middle of pillow 11 (where it has the most amount of stuffing), entrance 32 remains substantially closed, pinned down by seam 33 running along either side (see FIG. 2).

As shown in FIG. 1, trim 35 runs all the way across back face 15 of pillow 11, hiding from view running seam 33. Purposely, trim 35 appears to the observer as a deliberate decoration, enhancing the hidden aspect of pocket 20.

Although the preferred embodiment of the pillow of the invention is shown having a square-shaped design, any design such as round, oval or rectangle may be used without departing from the spirit and scope of the invention.

Typically, pillow 11 of the invention is placed on a bed or couch as a decorative accessory item, with front face 13 visible and back face 15 hidden from view. Such placement of pillow 11 further enhances the discreet aspect of the inventive design. Only if the situation is appropriate to retrieve a condom stored in pillow 11 is it then necessary to turn pillow 11 over, enabling hidden pocket 20 to be accessible.

It will thus be seen that the objects set forth above, among those made apparent from the preceding description, are efficiently attained and, since changes may be made in the inventive design without departing from the scope thereof, it is contemplated that all matter contained in the above description and shown in the drawings shall be interpreted as illustrative and not in a limiting sense.

It is further understood that the following claims are intended to cover all of the features of the invention therein described, and all statements of the scope of the invention which, as a matter of language, might be said to fall therebetween.

I claim:

1. A pillow comprising a front face, a back face and an interior stuffing material, at least one of said faces formed with a substantially centrally disposed pocket sized for selectively accommodating a packaged condom;

at least one of said faces being defined by a back fabric panel and an overlaying flap fabric panel;

said pocket being defined by a folded over pocket fabric panel having one edge sewn to the flap fabric panel and an opposite edge sewn to the back fabric panel.

2. The pillow claim 1, wherein said pocket has a square-shaped configuration.

3. The pillow of claim 1, wherein said pocket fabric panel and said flap fabric panel together define a pocket flap.

4. The pillow of claim 3, wherein said pocket flap is filled with a stuffing material.

5. The pillow of claim 1, wherein said pocket is centrally disposed under said flap fabric panel.

6. The pillow of claim 1, wherein said pocket has an access entrance.

7. The pillow of claim 6, wherein said flap fabric panel has an edge substantially continuous with said entrance.

8. The pillow of claim 6, wherein said flap fabric panel is sewn to said back fabric panel on either side of said entrance.

9. The pillow of claim 8, wherein said flap fabric panel is sewn to said back fabric panel in order to urge said pocket entrance to be substantially closed when said packaged condom is retained in said pocket.

10. The pillow of claim 8, wherein said sewn edge of said flap fabric panel on either side of said pocket entrance defines a discontinuous seam running across at least a portion of said at least one of said faces.

11. The pillow of claim 10, wherein said seam is hidden from view by an overlying decorative trim.

12. The pillow of claim 11, wherein said overlying decorative trim runs continuously across said at least one of said faces, thereby hiding said pocket entrance from view.

13. The pillow of claim 6, wherein said pocket entrance is formed without any closure element.

14. The pillow of claim 1, wherein said pocket has both a length and a width in an amount between about 4.5 inches and 6.0 inches.

15. A pillow and condom assembly comprising:

a front face, a back face and interior stuffing material, said back face including a back panel and a pocket flap cooperating with said back panel to form a substantially centrally disposed pocket on said back face, with some of said stuffing material being disposed in said pocket flap; and a condom selectively disposed in said pocket;

wherein said back panel and back flap with said stuffing material cooperating to maintain said condom hidden within said pocket when disposed therein and to close said pocket so that said disposed condom is maintained in said pocket when said pillow is turned upside down and/or shaken.

16. The assembly of claim 15, wherein said pocket has an entrance through which said condom is inserted, said back flap being attached to said back panel adjacent to said entrance to urge said entrance to a closed configuration.

17. The assembly of claim 16, wherein said back face has two opposed edges, and wherein said pocket flap has a first flap edge disposed at a predetermined distance from said opposed edges, with said entrance being formed along said flap edge into said pocket.

18. The assembly of claim 15 wherein said face, said pocket flap and said stuffing material cooperate to define a shape for said pillow, said shape remaining unchanged when said condom is removed from said pocket.

19. The assembly of claim 15, wherein said pocket is maintained closed without any additional closing elements.

* * * * *